US007585186B2

(12) United States Patent
McAlonis et al.

(10) Patent No.: US 7,585,186 B2
(45) Date of Patent: Sep. 8, 2009

(54) PERFORMANCE ENHANCING CONTACT MODULE ASSEMBLIES

(75) Inventors: Matthew Richard McAlonis, Elizabethtown, PA (US); Lynn Robert Sipe, Mifflintown, PA (US); James Lee Fedder, Etters, PA (US); Brent Ryan Rothermel, Pottstown, PA (US); Doug W. Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/869,417

(22) Filed: Oct. 9, 2007

(65) Prior Publication Data

US 2009/0093158 A1 Apr. 9, 2009

(51) Int. Cl.
*H01R 13/648* (2006.01)

(52) U.S. Cl. ..... 439/608

(58) Field of Classification Search ..... 439/608, 439/610, 108, 541.5, 701, 590; 361/777, 361/761; 333/182, 183; 174/250
See application file for complete search history.

(56) References Cited

U.S. PATENT DOCUMENTS 4,290,661 A 9/1981 Burns
4,488,768 A 12/1984 Sigmon
5,496,183 A 3/1996 Soes et al.
6,932,649 B1 * 8/2005 Rothermel et al. ..... 439/620.01
6,955,565 B2 10/2005 Lloyd et al.
7,131,870 B2 11/2006 Whiteman, Jr. et al.
7,172,461 B2 2/2007 Davis et al.
7,267,515 B2 * 9/2007 Lappohn ..... 439/608
7,285,018 B2 * 10/2007 Kenny et al. ..... 439/620.01

* cited by examiner

*Primary Examiner*—Alexander Gilman

(57) ABSTRACT

A contact module assembly includes a dielectric body having a mating end with a plurality of mating contacts and a mounting end with a plurality of mounting contacts. A lead frame is at least partially encased by the dielectric body, wherein the lead frame has a plurality of conductors representing both signal conductors and ground conductors extending alone a lead frame plane. The signal and ground conductors extend from respective ones of the mating contacts and the mounting contacts, wherein at least some of the ground conductors include a mating contact terminal proximate the respective mating contact and a mounting contact terminal proximate the respective mounting contact. The ground conductors extend only partially between the mating contact and the mounting contact associated with the respective ground conductor such that a gap exists between the mating contact terminal and the mounting contact terminal of the ground conductor. A commoning member electrically connects the mating contact terminal and the mounting contact terminal of at least one of the ground conductors, wherein the commoning member is oriented in a non-coplanar relation with the lead frame plane.

20 Claims, 6 Drawing Sheets

PERFORMANCE ENHANCING CONTACT MODULE ASSEMBLIES

BACKGROUND OF THE INVENTION

The subject matter herein relates generally to electrical connectors, and more particularly, to back plane connectors.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput. For example, performance demands for video, voice and data drive input and output speeds of connectors within such systems to increasingly faster levels.

In a traditional approach for interconnecting circuit boards, one circuit board serves as a back plane and the other as a daughter board. The back plane typically has a connector, commonly referred to as a header, which includes a plurality of signal contacts which connect to conductive traces on the back plane. The daughter board connector, commonly referred to as a receptacle, also includes a plurality of contacts. Typically, the receptacle is a right angle connector that interconnects the back plane with the daughter board so that signals can be routed therebetween. The right angle connector typically includes a mating face that receives the plurality of signal pins from the header on the back plane, and contacts on a mounting face that connect to the daughter board.

At least some right angle connectors include a plurality of contact modules that are received in a housing. The contact modules typically include a lead frame encased in a dielectric body. The lead frame includes a plurality of conductors that interconnect electrical contacts held on a mating end of the contact module with corresponding contacts held on a mounting end of the contact module. However, known connectors have problems operating at the higher performance levels of current systems. For example, known backplane connectors have limits to high speed electrical performance in the areas such as crosstalk, noise persistence, footprint impedance, and skew.

A need remains for a connector that overcomes at least some of the existing connector limitations to meet more demanding performance requirements in a cost effective and reliable manner.

BRIEF DESCRIPTION OF THE INVENTION

In one embodiment, a contact module assembly is provided that includes a dielectric body having a mating end with a plurality of mating contacts and a mounting end with a plurality of mounting contacts. A lead frame is at least partially encased by the dielectric body, wherein the lead frame has a plurality of conductors representing both signal conductors and ground conductors extending along a lead frame plane. The signal and ground conductors extend from respective ones of the mating contacts and the mounting contacts, wherein at least some of the ground conductors include a mating contact terminal proximate the respective mating contact and a mounting contact terminal proximate the respective mounting contact. The ground conductors extend only partially between the mating contact and the mounting contact associated with the respective ground conductor such that a gap exists between the mating contact terminal and the mounting contact terminal of the ground conductor. A commoning member electrically connects the mating contact terminal and the mounting contact terminal of at least one of the ground conductors, wherein the commoning member is oriented in a non-coplanar relation with the lead frame plane.

Optionally, the dielectric body may have a trench extending entirely therethrough at least partially along the gap between the mating contact terminal and the mounting contact terminal of at least one of the ground conductors. The dielectric body may have a side substantially parallel to the lead frame plane, wherein the commoning member extends along the side and includes at least one tab extending therefrom that engages the lead frame. Optionally, at least two adjacent conductors define ground conductors. The two adjacent ground conductors may cooperate to form a ground pad, wherein the commoning member is mechanically and electrically connected to the ground pad. Optionally, the signal conductors may have different lengths defined between the mating and mounting contacts, wherein the signal conductors define differential pairs, and wherein the longer signal conductors within a differential pair include at least one compensation region being wider than adjacent regions thereof, and at least a portion of the compensation region is exposed to air by a window in the dielectric body.

In another embodiment, an electrical connector is provided that includes a housing, and first and second contact module assemblies held by the housing. Each of the contact module assemblies include a dielectric body having a mating end with a plurality of mating contacts and a mounting end with a plurality of mounting contacts, and a lead frame at least partially encased by the dielectric body. The lead frame has a plurality of conductors representing both signal conductors and ground conductors extending along a lead frame plane, wherein the signal and ground conductors extending from respective ones of the mating contacts and the mounting contacts. At least some of the ground conductors include a mating contact terminal proximate the respective mating contact and a mounting contact terminal proximate the respective mounting contact, wherein the ground conductors extend only partially between the mating contact and the mounting contact associated with the respective ground conductor such that a gap exists between the mating contact terminal and the mounting contact terminal of the ground conductor. A commoning member electrically connects the mating contact terminal and the mounting contact terminal of at least one of the ground conductors, wherein the commoning member is oriented in a non-coplanar relation with the lead frame plane.

In a further embodiment, a contact module assembly is provided that includes a dielectric body having a mating end with a plurality of mating contacts and a mounting end with a plurality of mounting contacts, the dielectric body defining at least one window therein. A lead frame is at least partially encased by the dielectric body, wherein the lead frame has a plurality of conductors representing both ground conductors and signal conductors arranged as differential pairs. The signal conductors extend from respective ones of the mating contacts and the mounting contacts such that at least some of the signal conductors have different lengths defined between the mating and mounting contacts. The longer signal conductor within a differential pair includes at least one compensation region being wider than adjacent regions thereof, wherein at least a portion of the compensation region is exposed to air by a respective one of the windows in the dielectric body.

DETAILED DESCRIPTION OF THE INVENTION

Figure 1:
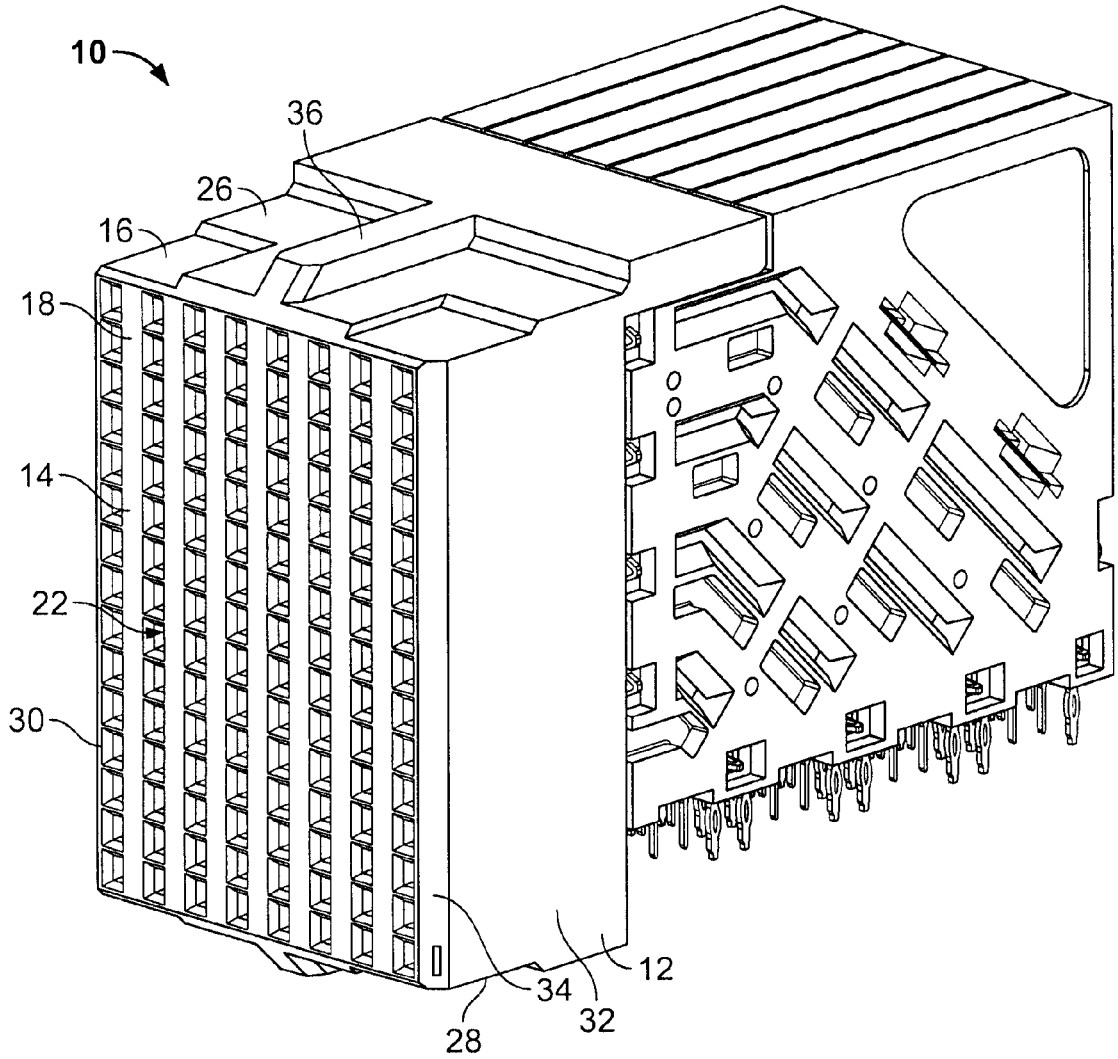
FIG. 1 is a perspective view of an exemplary embodiment of an electrical connector.
Figure 2:
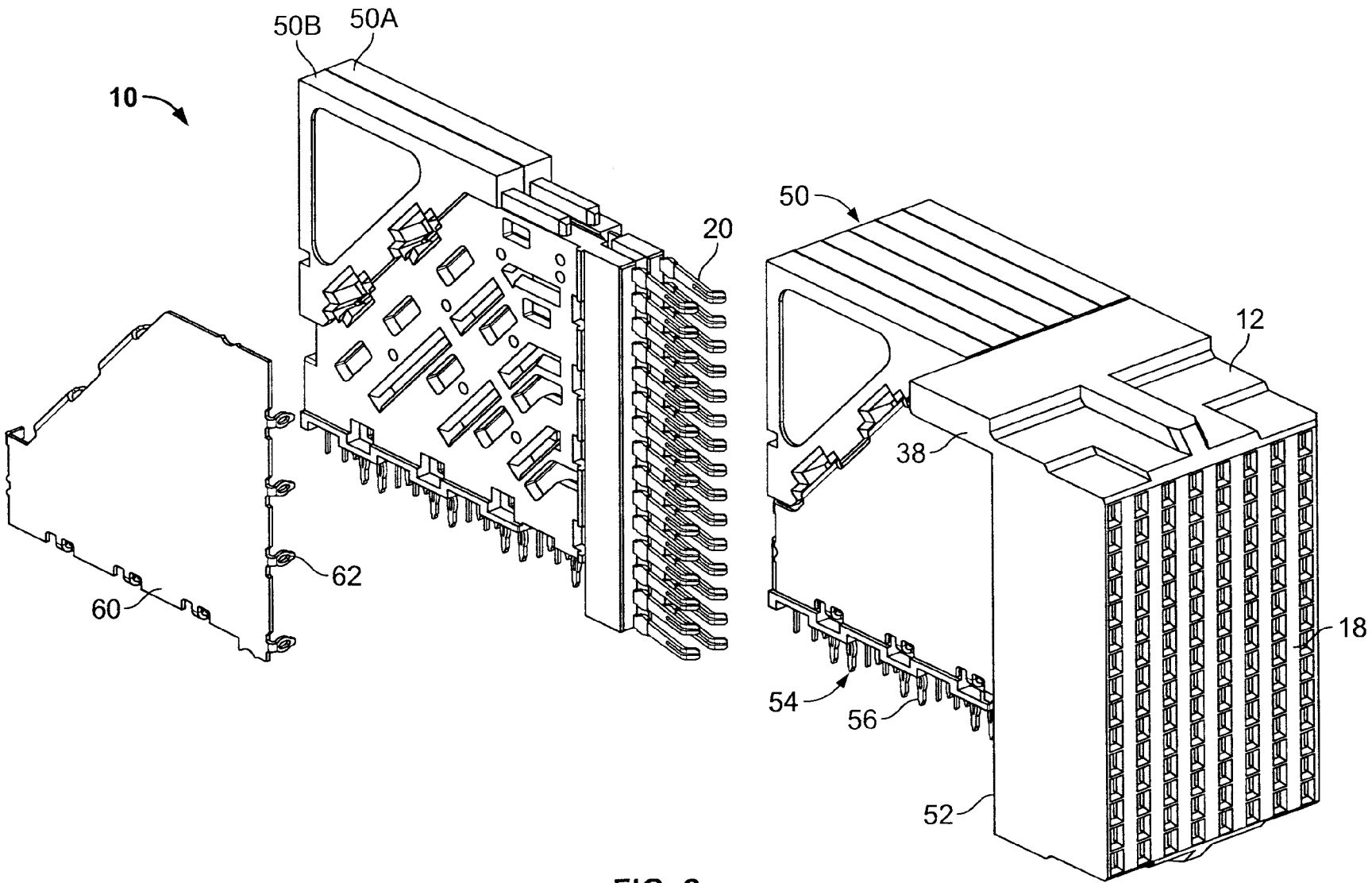
FIG. 2 is an exploded view of the electrical connector shown in FIG. 1 illustrating a plurality of contact module assemblies.

FIG. 1 illustrates an exemplary embodiment of an electrical connector 10. FIG. 2 is an exploded view of the electrical connector 10. While the connector 10 will be described with particular reference to a backplane receptacle connector, it is to be understood that the benefits herein described are also applicable to other connectors in alternative embodiments. The following description is therefore provided for purposes of illustration, rather than limitation, and is but one potential application of the subject matter herein.

As illustrated in FIG. 1, the connector 10 includes a dielectric housing 12 having a forward mating end 14 that includes a shroud 16 and a mating face 18. The mating face 18 includes a plurality of mating contacts 20 (shown in FIG. 2), such as, for example, contacts within contact cavities 22, that are configured to receive corresponding mating contacts (not shown) from a mating connector (not shown). The shroud 16 includes an upper surface 26 and a lower surface 28 between opposed sides 30, 32. The upper and lower surfaces 26, 28 and sides 30, 32 each include a chamfered forward edge portion 34. An alignment rib 36 is formed on the upper shroud surface 26 and lower shroud surface 28. The chamfered edge portion 34 and the alignment ribs 36 cooperate to bring the connector 10 into alignment with the mating connector during the mating process so that the contacts in the mating connector are received in the contact cavities 22 without damage.

As illustrated in FIG. 2, the housing 12 also includes a rearwardly extending hood 38. A plurality of contact module assemblies 50 are received in the housing 12 from a rearward end 52. The contact module assemblies 50 define a connector mounting face 54. The connector mounting face 54 includes a plurality of contacts 56, such as, but not limited to, pin contacts, that are configured to be mounted to a substrate (not shown), such as, but not limited to, a circuit board. In an exemplary embodiment, the mounting face 54 is substantially perpendicular to the mating face 18 such that the electrical connector 10 interconnects electrical components that are substantially at a right angle to one another. In one embodiment, the housing 12 holds two or more different types of contact module assemblies 50, such as, but not limited to, contact module assemblies 50A, 50B. Alternatively, the housing 12 may hold only a single type of contact module assembly 50, such as, but not limited to, any of the contact module assemblies 50A, 50B.

In an exemplary embodiment, each of the contact module assemblies 50 includes a commoning member 60 that extends along one side thereof. Optionally, the commoning member 60 may define a ground plane for the respective contact module assembly 50. In the illustrated embodiment, the commoning member 60 includes a plurality of contacts 62, such as eye-of-the-needle contacts, that electrically and mechanically connect to the contact module assembly 50. Optionally, the commoning member 60 may be used to provide shielding between adjacent contact module assemblies 50.

Figure 3:
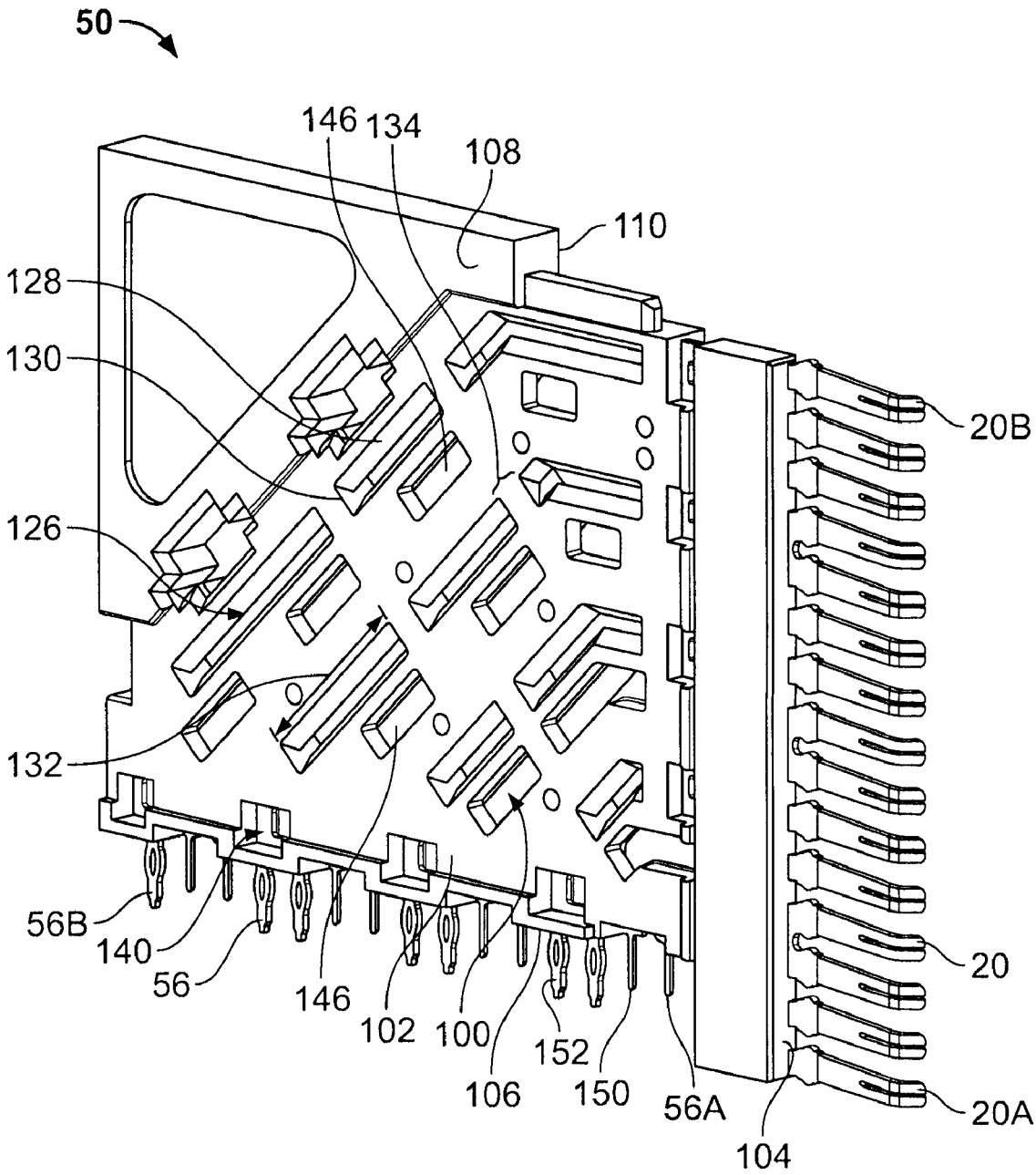
FIG. 3 is a perspective view of one of the contact module assemblies shown in FIG. 2.
Figure 4:
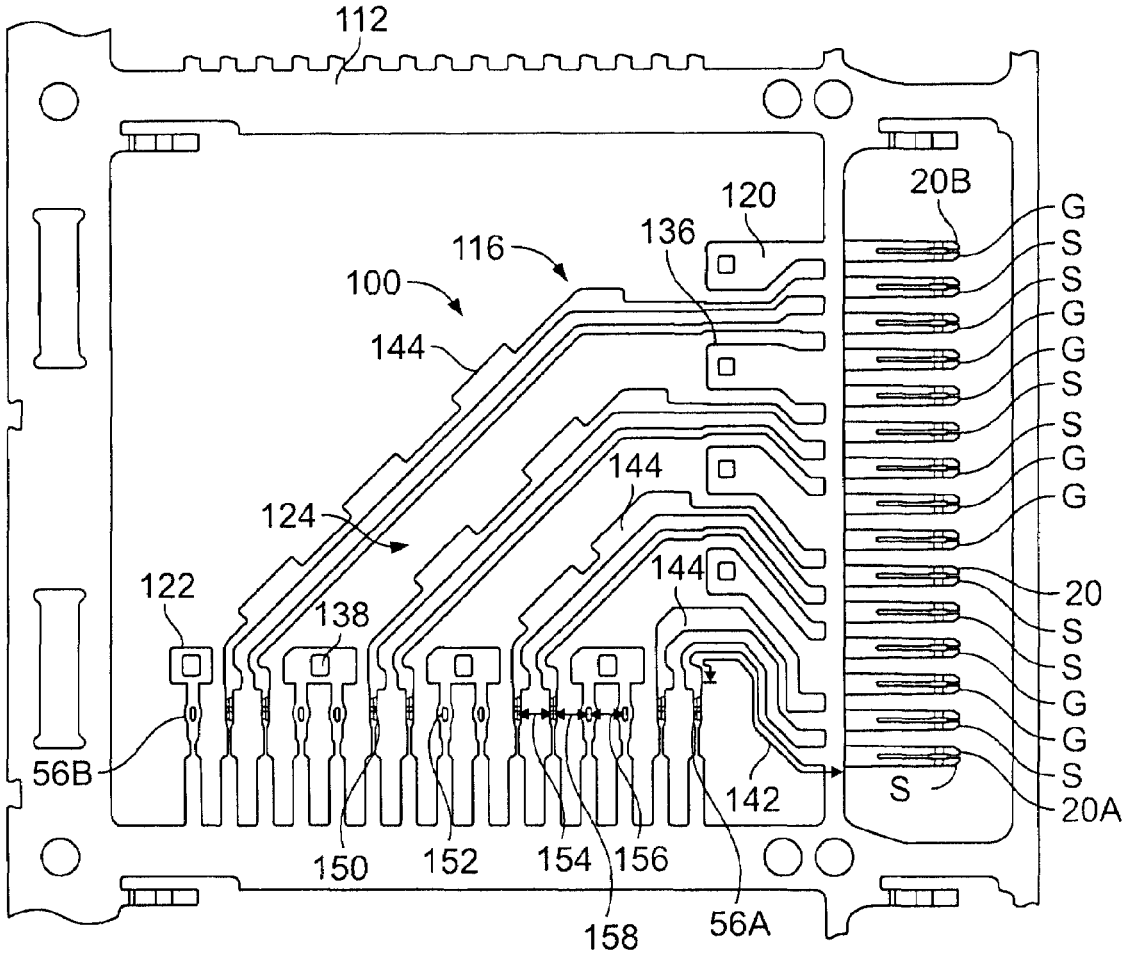
FIG. 4 is a side view of an exemplary embodiment of a lead frame for the contact module assembly shown in FIG. 3.

FIG. 3 illustrates an exemplary embodiment of one of the contact module assemblies 50 that includes an exemplary embodiment of an internal lead frame 100 and a dielectric body 102. FIG. 4 illustrates the lead frame 100 that is held within the dielectric body 102. The various features of the contact module assembly are designed to provide an electrical connector 10 operable at frequencies, densities and/or throughputs that are relatively higher than electrical connectors without some or all of the features described herein, by reducing crosstalk, reducing noise persistence, reducing impedance footprint mismatch and/or reducing intra-pair skew, as described in further detail below.

As illustrated in FIG. 3, the lead frame 100 is enclosed within the body 102, but is at least partially exposed by the body 102 in certain areas. In some embodiments, the body 102 is manufactured using an over-molding process. During the molding process, the lead frame 100 is encased in a dielectric material, which forms the body 102. The mating contacts 20 extend from a mating end portion 104 of the body 102, and the mounting contacts 56 extend from a mounting end portion 106 of the body 102 and the lead frame 100. The mating end portion 104 and the mounting end portion 106 are generally perpendicular to one another. In the illustrated embodiment, a mating contact 20A defines a radially inner mating contact, while a mating contact 20B defines a radially outer mating contact. Similarly, a mounting contact 56A defines a radially inner mounting contact, while a mounting contact 56B defines a radially outer mounting contact. The body 102 includes opposite side portions 108 and 110 that extend substantially parallel to and along the lead frame 100.

As illustrated in FIG. 4, the mating and mounting contacts 20, 56 are integrally formed with the lead frame 100. The lead frame 100 is generally planar and defines a lead frame plane. A carrier strip 112 initially holds the lead frame 100 and then is removed and discarded after the body 102 (shown in FIG. 3) is over-molded. The lead frame 100 includes a plurality of conductors 116 that extend along predetermined paths between each mating contact 20 to a corresponding mounting contact 56. In an exemplary embodiment, the contacts 20, 56 are integrally formed with, and define portions of, the conductors 116. Alternatively, the contacts 20, 56 may be terminated to the ends of the conductors 116. The conductors 116 may be either signal conductors, ground conductors, or power conductors. The lead frame 100 may include any number of conductors 116, any number of which may be selected as signal conductors, ground conductors, or power conductors according to a desired pinout selected for the contact module assembly 50. Optionally, adjacent signal conductors may function as differential pairs, and each differential pair may be separated by at least one ground conductor.

FIG. 4 illustrates the conductors 116 and associated contacts 20, 56 arranged according to an exemplary pinout for one contact module assembly, such as contact module assembly 50A. The lead frame 100 includes both ground and signal conductors (identified in FIG. 4 with either a G for ground or an S for signal), wherein the signal conductors are arranged as differential pairs. The lead frame 100 provides two ground conductors between each differential pair of signal conductors, such that a first pinout, as defined from the radially outer conductor, is ground-signal-signal-ground-ground-signal-signal-ground-ground-signal-signal-ground-ground-signal-signal. By providing two ground conductors between adjacent differential pairs, the separation between adjacent (e.g. nearest) signal conductors of the adjacent differential pairs is increased as compared to pinouts having only a single ground conductor therebetween. In some alternative embodiments, at least some of the signal conductors are separated by only a single ground conductor, more than two ground conductors, or alternatively, no ground conductors.

As further illustrated in FIG. 4, the conductors 116 defining the signal conductors extend entirely between the respective mating and mounting contacts 20, 56. However, each of the conductors 116 defining ground conductors extend only partially between the respective mating and mounting contacts 20, 56. The conductors 116 defining the ground conductors have mating contact terminals 120 proximate the mating contacts 20, and the conductors 116 defining the ground conductors have mounting contact terminals 122 proximate the mounting contacts 56. A gap 124 is defined between the mating contact terminal 120 and the mounting contact terminal 122 of each ground conductor.

By providing the gap 124, and removing at least a portion of the ground conductors between the mating and mounting contact terminals 120, 122, the noise persistence of the contact module assembly 50 may be reduced as compared to contact module assemblies having ground conductors that extend entirely between the mating and mounting contacts 20, 56. The amount of noise persistence (and noise persistence reduction) may be controlled by selecting a length of the gap 124 and a length of each of the mating contact terminal 120 and the mounting contact terminal 122. For example, the lengths of the mating contact terminal 120 and the mounting contact terminal 122 cooperate to define the length of the gap 124 (e.g. the distance between the mating contact terminal 120 and the mounting contact terminal 122), wherein the length of the gap 124 may be lengthened by decreasing the length of at least one of the mating contact terminal 120 and the mounting contact terminal 122. In some alternative embodiments, at least some of the ground conductors extend entirely between the mating and mounting contacts 20, 56, and the ground conductors may include terminals proximate the mating contacts 20 and/or the mounting contacts 56.

Returning to FIG. 3, in an exemplary embodiment, the body 102 includes a plurality of trenches 126 formed entirely through the body 102 between the sides 108, 110. The trenches 126 provide an air gap through the body 102. The trenches 126 are aligned with the gaps 124 (shown in FIG. 4). As such, the trenches 126 are provided between signal conductors of adjacent differential pairs. The trenches 126 are defined by side walls 128 and end walls 130. Optionally, the side walls 128 may be slanted and extend non-perpendicular from the sides 108, 110. The trenches 126 have lengths 132 measured between the end walls 130, and the lengths 132 are selected to balance structural integrity of the contact module assembly 50 with the enhancement in the electrical performance of the contact module assembly 50. For example, webs 134 are formed between trenches 126 that provide rigidity to the body 102. Additionally, the trenches 126 provide an air gap between signal conductors, which may decrease the cross-talk of the contact module assembly 50 by providing an air dielectric therebetween as opposed to only a plastic dielectric. Selecting the width and the length of the trenches 126 may balance these factors. Optionally, the trenches 126 may be filled with a dielectric material having certain characteristics that may enhance at least one of the stability and the electrical performance of the contact module assembly 50.

In an exemplary embodiment, and as illustrated in FIG. 4, adjacent ground conductors are commoned to form a ground pad 136. For example, the ground conductors are integrally formed with one another downstream of the respective contacts 20, 56. The ground pads 136 are more rigid and/or sturdier as compared to individual conductors 116, as the ground pad 136 is wider than an individual conductor 116. In an exemplary embodiment, and for reasons described more fully below, each of the ground pads 136 includes an opening 138 therethrough that receive the contacts 62 of the commoning member 60 (shown in FIG. 2). Additionally, as illustrated in FIG. 3, the body 102 includes openings 140 within the sides 108, 110 that are aligned with and provide access to at least a portion of the ground pads 136, and particularly, the openings 138. When connected, the commoning member 60 interconnects and electrically commons each of the ground conductors to which the commoning member 60 is connected. In some alternative embodiments, at least some of the ground conductors do not form ground pads and/or are not connected to the commoning member 60.

Each of the conductors 116 defining signal conductors have a predetermined length 142 defined between the mating contact 20 and the mounting contact 56. The lengths 142 of each of the signal conductors are different, due at least in part to the right angle nature of the contact module assembly 50. For example, the radially inner conductors 116 are generally shorter than the radially outer conductors 116. While each signal conductor within a differential pair has approximately equal lengths, because of factors such as the size constraint of the contact module assembly 50 and the cost or complexity of manufacture, the radially inner signal conductor within each differential pair is generally slightly shorter than the radially outer signal conductor. Any difference in length may lead to skew problems, as the signals within the differential pair travel along different path lengths.

In an exemplary embodiment, at least some of the signal conductors include compensation regions 144. For example, the radially outer signal conductors within each differential pair each include compensation regions 144. The compensation regions 144 are defined as having increased widths along the conductors 116. With reference back to FIG. 3, the compensation regions 144 are at least partially exposed to air by the body 102 to provide a different dielectric through which the signal conductor extends. For example, the body 102 includes windows 146 formed in the sides 108, 110 that expose the conductors 116 and/or the compensation regions 144. In an exemplary embodiment, the windows 146 only expose the radially outer signal conductor within each differential pair, such that the radially inner signal conductor remains encased along the corresponding portion of the length thereof. Within each differential pair, the different dielectric (e.g. air for the radially outer signal conductor) allows the differential signal of the radially outer conductor to travel at a different rate along the compensation region 144 as compared to the rate of travel of the differential signal of the radially inner conductor through another dielectric (e.g. plastic). In alternative embodiments, rather than air, the window may be filled with a different dielectric having different characteristics than the dielectric of the body 102 that allows the signal to travel at a faster rate. Additionally, in other alternative embodiments, the radially inner signal conductors (rather than, or in addition to, the radially outer conductor having the compensation region 144) may include compensation regions that travel through a dielectric having a different characteristic that slows the travel of the signal therethrough.

The compensation regions 144 generally have a longitudinal axis extending substantially parallel to the length of the conductor 116 extending from the mating contact 20 to the mounting contact 56. In the illustrated embodiment, the compensation regions 144 are generally rectangular extensions extending radially outward from the radially outer signal conductor. In an exemplary embodiment, the compensations regions 144 extend at least partially into the gaps 124 created by the absence of at least part of the ground conductors. The number, size and shape of the compensation regions 144 may be selected to substantially reduce skew. For example, by increasing the size or number of compensation regions 144, the skew may be reduced as compared to smaller or less compensation regions 144. Additionally, the increased width in the compensation region 144 controls the impedance, as the impedance changes with the change in dielectric constant.

In an exemplary embodiment, the mounting contacts 56 of the signal conductors, shown in the figures as signal mounting contacts 150, are different than the mounting contacts 56 of the ground conductors, shown in the figures as ground mounting contacts 152. For example, the ground mounting contacts 152 are represented by eye-of-the-needle contacts and the signal mounting contacts 150 are represented by micro-compliant pins that have a reduced cross section as compared to eye-of-the-needle pins. However in alternative embodiments, different types of contacts may be used for either the signal or ground mounting contacts 150, 152 and the signal and ground mounting contacts 150, 152 may be the same types of contacts.

In the illustrated embodiment, the ground mounting contacts 152 are longer than the signal mounting contacts 150 and are mated to the circuit board prior to the signal mounting contacts 150 being mounted thereto. The ground mounting contacts 152 are designed to engage the circuit board prior to the signal mounting contacts 150 to provide alignment and/or keying for the signal mounting contacts 152. For example, an alignment tolerance of the signal mounting contacts 150 may be less than a tolerance of the ground mounting contacts 152 such that the ground mounting contacts 152 are guided into respective mounting holes to more accurately align the signal mounting contacts 150 with respective signal mounting holes. Additionally, because the ground mounting contacts 152 are longer, and mounted within respective holes prior to the signal mounting contacts 150, the mating force of the electrical connector 10 (shown in FIG. 1) may be reduced as less than all of the mounting contacts 56 are engaging the holes at one time.

The signal mounting contacts 150 are generally smaller (e.g. narrower or have a reduced cross section) than the ground mounting contacts 152. As such, and as illustrated in FIG. 4, while each of the mating contacts 56 has substantially the same centerline spacing (i.e. the centers of adjacent mounting holes on the circuit board are the same distance from each other), a spacing 154 between adjacent signal mounting contacts 150 is increased as compared to a spacing 156 between adjacent ground mounting contacts 152. Additionally, the spacing 154 is increased as compared to a spacing 158 between the signal mounting contact 150 and the adjacent ground mounting contact 152. The increased spacing 154 may reduce the impedance between the adjacent signal mounting contacts 150 which may increase the overall performance of the contact module assembly 50 as compared to contact module assemblies that use larger signal mounting contacts. For example, the increased spacing spreads the signals which reduces capacitive coupling with each other, which reduces impedance. Similarly, the signal mounting contacts 150 are received in vias or holes in the circuit board that have a corresponding reduced size or diameter. The reduced diameter of the vias similarly increases the spacing therebetween which may reduce the impedance.

Figure 5:
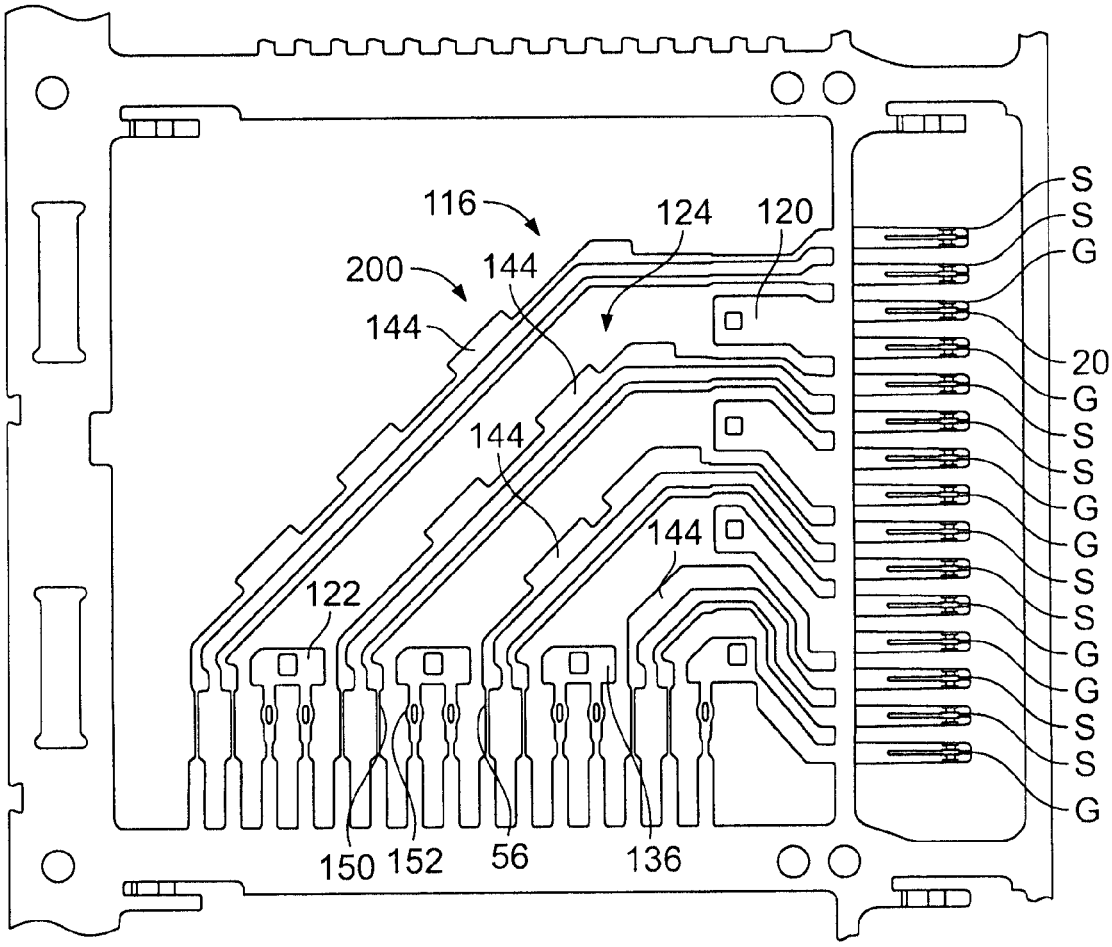
FIG. 5 is a side view of an alternative embodiment of a lead frame for another one of the contact module assemblies shown in FIG. 2.

FIG. 5 is a side view of an alternative embodiment of a lead frame 200 for another one of the contact module assemblies, such as the contact module assembly 50B, shown in FIG. 2. The lead frame 200 is similar to the lead frame 100 in some aspects, and like reference characters of the lead frame 100 are utilized in FIG. 5 to denote like features of the lead frame 200. The lead frame 200 may be at least partially enclosed by a dielectric to form the body 102 of the contact module assembly 50B.

The lead frame 200 includes the mating and mounting contacts 20, 56, and the conductors 116 that extend along predetermined paths between each mating contact 20 to a corresponding mounting contact 56. FIG. 5 illustrates the conductors 116 and associated contacts 20, 56 arranged according to an exemplary pinout, that is different than the pinout (shown in FIG. 4) for the contact module assembly 50A. The lead frame 200 includes both ground and signal conductors, wherein the signal conductors are arranged as differential pairs. The lead frame 200 provides two ground conductors between each differential pair of signal conductors, such that a second pinout, as defined from the radially outer conductor, is signal-signal-ground-ground-signal-signal-ground-ground-signal-signal-ground-ground-signal-signal-ground.

The first and second pinouts are different from one another such that, when the contact module assemblies 50A (having the lead frame 100 with the first pinout) is placed within the housing 12 (shown in FIGS. 1 and 2) adjacent to at least one of the contact module assemblies 50B (having the lead frame 200 with the second pinout), then the signal contacts are at least partially offset with respect to one another. By staggering the signal conductors of adjacent contact module assemblies 50A, 50B, the electrical performance of the electrical connector 10 may be increased, such as by reducing crosstalk. Additionally, by providing pinouts having double ground conductors between the differential pairs, the spacing between each differential pair of signal conductors is increased further than if only a single ground conductor was positioned therebetween, thus reducing the crosstalk even further.

As with the lead frame 100, the conductors 116 of the lead frame 200 that define the signal conductors extend entirely between the respective mating and mounting contacts 20, 56. However, the conductors 116 defining ground conductors extend only partially between the respective mating and mounting contacts 20, 56 to form the gaps 124. The trenches 126 in the body 102 may be provided along the gaps 124. The conductors 116 defining the ground conductors have mating contact terminals 120 proximate the mating contacts 20, and the conductors 116 defining the ground conductors have mounting contact terminals 122 proximate the mounting contacts 56. Adjacent ground conductors form the ground pads 136 that receive the commoning member 60 (shown in FIG. 2). Each of the conductors 116 defining signal conductors include compensation regions 144 that may be exposed by windows 146 in the body 102. As with the lead frame 100, the signal mounting contacts 150 of the signal conductors of the lead frame 200 are different than the ground mounting contacts 152. For example, the ground mounting contacts 152 are represented by eye-of-the-needle contacts and the signal mounting contacts 150 are represented by micro-compliant pins that have a reduced cross section as compared to eye-of-the-needle pins.

Figure 6:
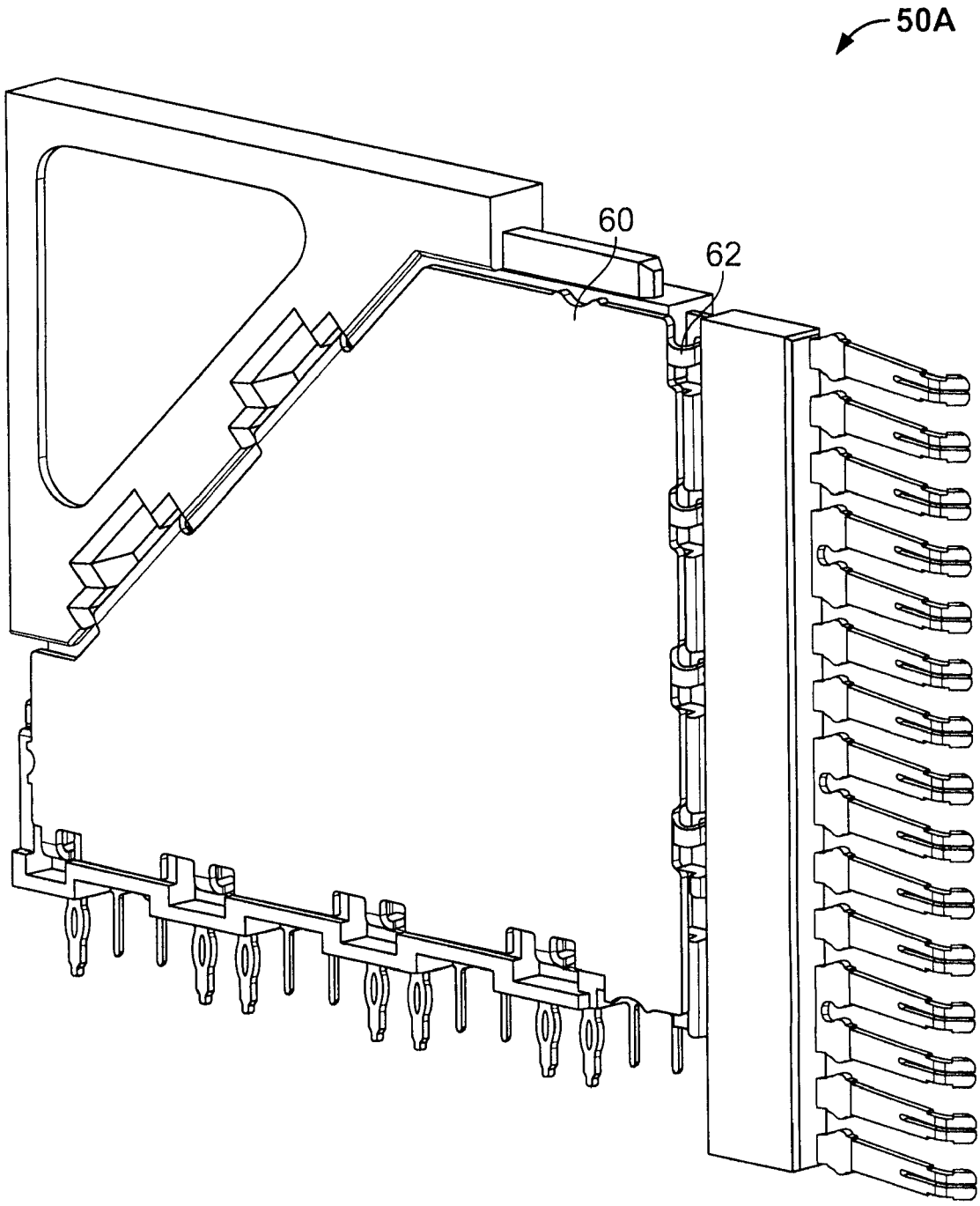
FIG. 6 is an assembled view of the contact module assembly shown in FIG. 3, with an exemplary commoning member affixed thereto.

FIG. 6 is an assembled view of the contact module assembly 50A (shown in FIG. 2), with an exemplary commoning member 60 affixed thereto. While FIG. 6 illustrates the contact module assembly 50A, having the lead frame 100 (shown in FIG. 4), it is realized that the contact module assembly 50B (shown in FIG. 2), that includes the lead frame 200 (shown in FIG. 5) would include a similar commoning member 60.

During assembly, the commoning member 60 is mounted to the contact module assembly 50A. The contacts 62 of the commoning member 60 are electrically and mechanically connected to the ground pads 136 (shown in FIG. 4) to electrically common each ground pad 136 to one another. In some embodiments, the commoning member 60 is connected to less than all of the ground pads 136. When installed, the commoning member 60 defines a ground plane that is oriented parallel to, but in a non-coplanar relation with, the lead frame plane. Because there are no redundant grounds between the signal conductors, the noise persistence of the contact module assembly 50A may be reduced, as compared to contact module assemblies that have ground conductors in plane, and in between respective ones of the signal conductors.

In an exemplary embodiment, when the commoning member 60 is installed, the commoning member 60 covers each of the signal conductors of the lead frame 100. As such, the commoning member may effectively shield each of the signal conductors from an adjacent contact module assembly when the contact module assemblies are assembled within the housing 12 (shown in FIGS. 1 and 2).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A contact module assembly comprising:

a dielectric body having a mating end with a plurality of mating contacts and a mounting end with a plurality of mounting contacts;

a lead frame at least partially enclosed by the dielectric body, the lead frame having signal conductors and ground conductors, the signal and ground conductors held by the dielectric body within and extending along a lead frame plane, at least one of the ground conductors including a mating segment located at the mating end and a mounting segment located at the mounting end, the mating and mounting segments being electrically separated and spaced apart from one another along the lead frame plane by a gap therebetween, the mating segment including a mating contact terminal located proximate to the gap and the mounting segment including a mounting contact terminal located proximate to the gap; and a commoning member mounted to a side of the dielectric body, the commoning member electrically engaging the mating contact terminal and the mounting contact terminal to electrically connect the mating segment and the mounting segment of at least one of the ground conductors.

2. The assembly of claim 1, wherein the signal conductors and ground conductors extend from respective ones of the mating contacts and the mounting contacts.

3. The assembly of claim 1, wherein the dielectric body has a trench extending entirely therethrough at least partially along the gap between the mating contact terminal and the mounting contact terminal of at least one of the ground conductors.

4. The assembly of claim 1, wherein the side of the dielectric body is substantially parallel to and spaced apart from the lead frame plane, the commoning member is mounted to the side such that the dielectric body extends between the lead frame plane and the commoning member, the commoning member having at least one tab oriented to traverse the lead frame plane and electrically engage the mating contact terminal and the mounting contact terminal of at least one ground conductor.

5. The assembly of claim 1, wherein the ground conductors are entirely contained within the lead frame plane, the commoning member is spaced apart from the lead frame plane in a non-coplanar orientation with respect to the lead frame plane.

6. The assembly of claim 1, wherein the signal and ground conductors of the lead frame are stamped from a common blank, and the dielectric body is overmolded around portions of the signal and ground conductors.

7. The assembly of claim 1, wherein the signal and ground conductors define a pinout having signal conductors arranged as differential pairs, wherein a first ground conductor is provided on one side of one of the differential pairs of signal conductors and a second ground conductor is provided on an opposite side of the same differential pair, the first and second ground conductors are discrete and physically separate from one another and electrically connected by the commoning member.

8. The assembly of claim 1, wherein the signal conductors have a thickness extending in a direction defined between opposed sides of the dielectric body, the ground conductors have a thickness that is substantially identical to the thickness of the signal conductors.

9. An electrical connector comprising:

a housing;

first and second contact module assemblies held by the housing, each of the contact module assemblies comprising:

a dielectric body having a mating end with a plurality of mating contacts and a mounting end with a plurality of mounting contacts;

a lead frame at least partially enclosed by the dielectric body, the lead frame having signal conductors and ground conductors, the signal and ground conductors held by the dielectric body within and extending along a lead frame plane, at least one of the ground conductors including a mating segment located at the mating end and a mounting segment located at the mounting end, the mating and mounting segments being electrically separated and spaced apart from one another along the lead frame plane by a gap therebetween, the mating segment including a mating contact terminal located proximate to the gap and the mounting segment including a mounting contact terminal located proximate to the gap; and a commoning member mounted to a side of the dielectric body, the commoning member electrically engaging the mating contact terminal and the mounting contact terminal to electrically connect the mating segment and the mounting segment of at least one of the ground conductors.

10. The electrical connector of claim 9, wherein for each of the contact module assemblies the dielectric body has a trench extending entirely therethrough at least partially along the gap between the mating contact terminal and the mounting contact terminal of at least one of the ground conductors.

11. The electrical connector of claim 9, wherein for each of the contact module assemblies the signal conductors are arranged in differential pairs, the signal conductors have different lengths defined between the mating and mounting contacts, the signal conductors have a generally constant width defined between the mating and mounting contacts, wherein one of the signal conductors within each differential pair includes at least one compensation region, the compensation region being an integral part of the conductor that extends outward therefrom within the lead frame plane such that the signal conductors are wider along the segments of the signal conductors having the compensation regions, wherein at least a portion of the compensation region is exposed to air by a window in the dielectric body.

12. The electrical connector of claim 9, wherein the commoning member of the second contact module assembly is positioned between the signal conductors of the first contact module assembly and the signal conductors of the second contact module assembly to provide shielding between the signal conductors of the contact module assemblies.

13. The electrical connector of claim 9, wherein the lead frames of the contact module assemblies are different from one another such that at least some of the signal conductors of the first contact module assembly are directly aligned with a corresponding gap between the mating contact terminal and the mounting contact terminal of at least one of the ground conductors of the second contact module assembly when the contact module assemblies are held within the housing.

14. A contact module assembly comprising:

a dielectric body having a mating end with a plurality of mating contacts and a mounting end with a plurality of mounting contacts, the dielectric body defining at least one window therein; and a lead frame at least partially enclosed by the dielectric body, the lead frame having ground conductors and signal conductors, the signal conductors extend from respective ones of the mating contacts to respective ones of the mounting contacts, the signal conductors including first and second signal conductors arranged in a differential pair, the first signal conductor being longer than the second signal conductor, the first signal conductor having a length extending between the mating and mounting contacts and the first signal conductor having a first width provided along at least a portion of the length, the first signal conductor including a compensation region formed as a segment along the length of the first signal conductor, the segment forming the compensation region having a second width that is wider than the first width, at least a portion of the compensation region being aligned with, and exposed to air by, a respective one of the windows in the dielectric body.

15. The assembly of claim 14, wherein the compensation region of the first signal conductors is exposed by the windows for a predetermined length of the segment, wherein the predetermined length is selected to compensate by a certain amount for skew created by an added signal path length of the first signal conductor.

16. The assembly of claim 14, wherein the window is elongated and has a longitudinal axis substantially parallel to the length of the compensation region.

17. The assembly of claim 14, wherein at least some of the ground conductors include a mating contact terminal proximate the respective mating contact and a mounting contact terminal proximate the respective mounting contact, the ground conductors extend only partially between the mating contact and the mounting contact associated with the respective ground conductor such that a gap exists between the mating contact terminal and the mounting contact terminal of the ground conductor.

18. The assembly of claim 14, wherein the dielectric body has a trench extending entirely therethrough, the trench being positioned between signal conductors of adjacent differential pairs, and the trench having a longitudinal axis extending substantially parallel to the adjacent signal conductors.

19. The assembly of claim 14, wherein the ground conductors are discrete from one another, the assembly further comprising a commoning member electrically connecting the ground conductors to one another, wherein the commoning member is non-coplanar with the lead frame.

20. The assembly of claim 14, wherein the dielectric body has opposed sides, the signal and ground conductors being discrete from one another and being held within and extend along a lead frame plane that is parallel to and non-coplanar with the sides of the dielectric body, the commoning member is mounted to one of the sides of the dielectric body such that the commoning member is oriented in a non-coplanar relation with the lead frame plane.

* * * * *